US010184160B2

(12) United States Patent
Sawawatari et al.

(10) Patent No.: US 10,184,160 B2
(45) Date of Patent: Jan. 22, 2019

(54) DUAL PHASE STAINLESS STEEL PIPE AND MANUFACTURING METHOD THEREOF

(71) Applicant: NIPPON STEEL & SUMITOMO METAL CORPORATION, Tokyo (JP)

(72) Inventors: Naoki Sawawatari, Tokyo (JP); Koichi Kuroda, Tokyo (JP); Masaki Ueyama, Tokyo (JP); Yusuke Ugawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 557 days.

(21) Appl. No.: 14/402,882

(22) PCT Filed: Aug. 22, 2013

(86) PCT No.: PCT/JP2013/072424

§ 371 (c)(1),
(2) Date: Nov. 21, 2014

(87) PCT Pub. No.: WO2014/034522

PCT Pub. Date: Mar. 6, 2014

(65) Prior Publication Data

US 2015/0107724 A1 Apr. 23, 2015

(30) Foreign Application Priority Data

Aug. 31, 2012 (JP) ..... 2012-190996

(51) Int. Cl.
*C21D 9/08* (2006.01)
*B21D 3/04* (2006.01)
(Continued)

(52) U.S. Cl.
CPC ..... *C21D 9/08* (2013.01); *B21B 3/02* (2013.01); *B21D 3/04* (2013.01); *C21D 6/004* (2013.01);
(Continued)

(58) Field of Classification Search
CPC ..... B21B 19/06; B21B 3/02; C21D 2211/001; C21D 2211/005; C21D 8/10; C21D 9/08
(Continued)

(56) References Cited

U.S. PATENT DOCUMENTS 7,892,368 B2 * 2/2011 Tsuru ..... B21C 37/065 138/171
8,293,037 B2 * 10/2012 Suwabe ..... B21C 23/085 148/506
(Continued)

FOREIGN PATENT DOCUMENTS

CN 102282273 A 12/2011
EP 1541262 A1 6/2005
(Continued)

OTHER PUBLICATIONS

International Search Report issued in PCT/JP2013/072424, dated Nov. 26, 2013.
(Continued)

*Primary Examiner* — Jie Yang
(74) *Attorney, Agent, or Firm* — Birch, Stewart, Kolasch & Birch, LLP

(57) ABSTRACT

A dual phase stainless steel pipe includes tensile yield strength $YS_{LT}$ of 689.1 MPa to 1000.5 MPa in a pipe axis direction of the dual phase stainless steel pipe, in which the tensile yield strength $YS_{LT}$, a compressive yield strength $YS_{LC}$ in the pipe axis direction, a tensile yield strength $YS_{CT}$ in a pipe circumferential direction of the dual phase stainless steel pipe, and a compressive yield strength $YS_{CC}$ in the pipe circumferential direction satisfy all Expressions (1) to (4), $$0.90 \leq YS_{LC}/YS_{LT} \leq 1.11 \quad (1)$$

$$0.90 \leq YS_{CC}/YS_{CT} \leq 1.11 \quad (2)$$

$$0.90 \leq YS_{CC}/YS_{LT} \leq 1.11 \quad (3)$$

(Continued)

$0.90 \leq YS_{CT}/YS_{LT} \leq 1.11$ (4).

6 Claims, 6 Drawing Sheets

(51) Int. Cl.

| | |
|---|---|
| ***B21B 3/02*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C21D 6/00*** | (2006.01) |
| ***C21D 7/10*** | (2006.01) |
| *B21B 19/06* | (2006.01) |

(52) U.S. Cl.
CPC ..... *C21D 6/005* (2013.01); *C21D 6/008* (2013.01); *C21D 7/10* (2013.01); *C21D 8/10* (2013.01); *C21D 8/105* (2013.01); *C22C 38/001* (2013.01); *C22C 38/02* (2013.01); *C22C 38/04* (2013.01); *C22C 38/42* (2013.01); *C22C 38/44* (2013.01); *B21B 19/06* (2013.01); *C21D 2211/001* (2013.01); *C21D 2211/005* (2013.01)

(58) Field of Classification Search
USPC ..... 148/500
See application file for complete search history.

(56) References Cited

U.S. PATENT DOCUMENTS

| | | | | |
|---|---|---|---|---|
| 9,429,254 | B2 * | 8/2016 | Sawawatari | C21D 8/10 |
| 2010/0221788 | A1 | 9/2010 | Radmacher et al. | |
| 2011/0290377 | A1 | 12/2011 | Suwabe et al. | |

FOREIGN PATENT DOCUMENTS

| | | | |
|---|---|---|---|
| EP | 2 163 622 | A1 | 3/2010 |
| EP | 2177634 | A1 | 4/2010 |
| JP | 63-210236 | A | 8/1988 |
| JP | 10-80715 | A | 3/1998 |
| JP | 11-57842 | A | 3/1999 |
| JP | 2005-15823 | A | 1/2005 |

OTHER PUBLICATIONS

Extended European Search Report, dated Feb. 25, 2016, for European Application No. 13833720.9.
Chinese Office Action, Search Report and English translation dated Dec. 3, 2015 for counterpart Application No. 201380034033.1.
Chinese Notification of the Reexamination Decision for counterpart Chinese Application No. 201380034033.1, dated Apr. 24, 2018, with an English translation.
Wang, "Metal Plastic Processing Rolling Theory and Process, Compiled," Metallurgic Industry Press. May 1998, pp. 252-256 (8 pages) with English translation.

* cited by examiner

DUAL PHASE STAINLESS STEEL PIPE AND MANUFACTURING METHOD THEREOF

TECHNICAL FIELD OF THE INVENTION

The present invention relates to a dual phase stainless steel pipe and a manufacturing method thereof.

Priority is claimed on Japanese Patent Application No. 2012-190996, filed on Aug. 31, 2012, the content of which is incorporated herein by reference.

RELATED ART

Oil well pipes are used in an oil well or a gas well (hereinafter, oil wells and gas wells are generally referred to as "oil wells"). Oil wells are in corrosive environments. For this reason, oil well pipes are required to have corrosion resistance. A dual phase stainless steel having a dual phase structure of austenite and ferrite has excellent corrosion resistance. Therefore, a dual phase stainless steel pipe is used for an oil well pipe.

Types of oil well pipes include casings and tubing. The casings are inserted into a well. Cement fills a space between the casing and a wall of the well, and thus the casing is fixed into the well. The tubing is inserted into the casing, and produced fluid such as oil or gas passes through the tubing.

The oil well pipe is required to have corrosion resistance and high strength. In general, strength grade of the oil well pipe is defined by the tensile yield strength in the pipe axis direction. A user of the oil well pipe deduces an environment of a well (geopressure, temperature and pressure of the produced fluid) to be drilled from test drilling or a geological survey, and selects the oil well pipe having durably usable strength grade.

Japanese Unexamined Patent Application, First Publication No. H10-80715 (Patent Document 1) and Japanese Unexamined Patent Application, First Publication No. H11-57842 (Patent Document 2) propose a manufacturing method for increasing the compressive yield strength in the pipe axis direction.

In a manufacturing method of a steel pipe disclosed in Patent Document 1, a ratio Q between outer diameter working degree and thickness working degree at the time of cold working ($Q=R_T/R_D$: $R_T$ is a thickness reduction ratio, and $R_D$ is an outer diameter reduction ratio) is adjusted to be less than or equal to 1.5. Accordingly, a steel pipe having excellent compressive yield strength in the pipe axis direction is obtained. Specifically, the compressive yield strength in the pipe axis direction of the steel pipe is greater than or equal to 80% of the tensile yield strength (the proof stress of 0.2%).

In a manufacturing method of a steel pipe disclosed in Patent Document 2, a heat treatment is performed at 200° C. to 450° C. with respect to the steel pipe which is subjected to cold working. In Patent Document 2, it is disclosed that a dislocation which is introduced into the steel by cold working is reoriented by the heat treatment, and thus the compressive yield strength in the pipe axis direction increases. Specifically, according to the manufacturing method disclosed in Patent Document 2, the compressive yield strength in the pipe axis direction of the steel pipe is greater than or equal to 80% of the tensile yield strength (the proof stress of 0.2%).

PRIOR ART DOCUMENT

Patent Document

[Patent Document 1] Japanese Unexamined Patent Application, First Publication No. H10-80715

[Patent Document 2] Japanese Unexamined Patent Application, First Publication No. H11-57842

DISCLOSURE OF THE INVENTION

Problems to be Solved by the Invention

However, when the dual phase stainless steel pipe is used as the oil well pipe, a distribution of stress applied to the oil well pipe is changed according to a use environment of the oil well pipe. Therefore, even when the oil well pipe in which the compressive yield strength in the pipe axis direction increases according to the manufacturing methods disclosed in Patent Documents 1 and 2 are used, the stress applied from a direction other than a pipe axis direction may increase according to the use environment of the oil well pipe. Therefore, it is preferable that the oil well pipe also be usable with respect to the stress applied from a direction other than a pipe axis direction. Further, in the manufacturing methods disclosed in Patent Documents 1 or 2, a difference between the compressive yield strength and the tensile yield strength in the pipe axis direction of the dual phase stainless steel pipe may not be sufficiently reduced.

The present invention is to provide a dual phase stainless steel pipe which is able to be durably used even when various stress distributions are applied in accordance with a use environment.

Means for Solving the Problem (1) A dual phase stainless steel pipe according to a first aspect of the present invention includes a tensile yield strength $YS_{LT}$ of 689.1 MPa to 1000.5 MPa in a pipe axis direction of the dual phase stainless steel pipe, in which the tensile yield strength $YS_{LT}$, a compressive yield strength $YS_{LC}$ in the pipe axis direction, a tensile yield strength $YS_{CT}$ in a pipe circumferential direction of the dual phase stainless steel pipe, and a compressive yield strength $YS_{CC}$ in the pipe circumferential direction satisfy all Expressions (a) to (d).

$$0.90 \leq YS_{LC}/YS_{LT} \leq 1.11 \quad \text{(a)}$$

$$0.90 \leq YS_{CC}/YS_{CT} \leq 1.11 \quad \text{(b)}$$

$$0.90 \leq YS_{CC}/YS_{LT} \leq 1.11 \quad \text{(c)}$$

$$0.90 \leq YS_{CT}/YS_{LT} \leq 1.11 \quad \text{(d)}$$

(2) In the dual phase stainless steel pipe according to (1), the dual phase stainless steel pipe may contain, in mass %, C: 0.008% to 0.03%; Si: 0% to 1%; Mn: 0.1% to 2%; Cr: 20% to 35%; Ni: 3% to 10%; Mo: 0% to 4%; W: 0% to 6%; Cu: 0% to 3%; and N: 0.15% to 0.35%, and a remainder composed of Fe and impurities.

(3) In the dual phase stainless steel pipe according to (1) or (2), the dual phase stainless steel pipe may be manufactured by performing a straightening and a low temperature heat treatment at a heat treatment temperature of 350° C. to 450° C. after being subjected to cold working.

(4) In the dual phase stainless steel pipe according to (3), the dual phase stainless steel pipe may be manufactured by performing the low temperature heat treatment after the straightening.

(5) A manufacturing method of a dual phase stainless steel pipe according to a second aspect of the present invention includes manufacturing a dual phase stainless steel raw pipe; performing a cold working on the raw pipe; manufacturing the dual phase stainless steel pipe in which tensile yield strength $YS_{LT}$ of 689.1 MPa to 1000.5 MPa in a pipe axis direction of the dual phase stainless steel pipe is included and the tensile yield strength $YS_{LT}$, a compressive yield strength $YS_{LC}$ in the pipe axis direction, a tensile yield strength $YS_{CT}$ in a pipe circumferential direction of the dual phase stainless steel pipe, and a compressive yield strength $YS_{CC}$ in the pipe circumferential direction satisfy all Expressions (a) to (d) by performing a straightening and a low temperature heat treatment at a heat treatment temperature of 350° C. to 450° C. with respect to the raw pipe which is subjected to the cold working.

$$0.90 \leq YS_{LC}/YS_{LT} \leq 1.11 \quad (a)$$

$$0.90 \leq YS_{CC}/YS_{CT} \leq 1.11 \quad (b)$$

$$0.90 \leq YS_{CC}/YS_{LT} \leq 1.11 \quad (c)$$

$$0.90 \leq YS_{CT}/YS_{LT} \leq 1.11 \quad (d)$$

(6) In the manufacturing method of a dual phase stainless steel pipe according to (5), the low temperature heat treatment may be performed with respect to the raw pipe after the straightening.

(7) In the manufacturing method of a dual phase stainless steel pipe according to (5) or (6), the raw pipe may contain, in mass %, C: 0.008% to 0.03%; Si: 0% to 1%; Mn: 0.1% to 2%; Cr: 20% to 35%; Ni: 3% to 10%; Mo: 0% to 4%; W: 0% to 6%; Cu: 0% to 3%; and N: 0.15% to 0.35%, and a remainder composed of Fe and impurities.

Effects of the Invention

A dual phase stainless steel pipe according to the aspect of the present invention has small anisotropy of yield strength, and thus it is able to be durably used even when a different stress distribution is applied according to a use environment.

EMBODIMENTS OF THE INVENTION

Figure 1:
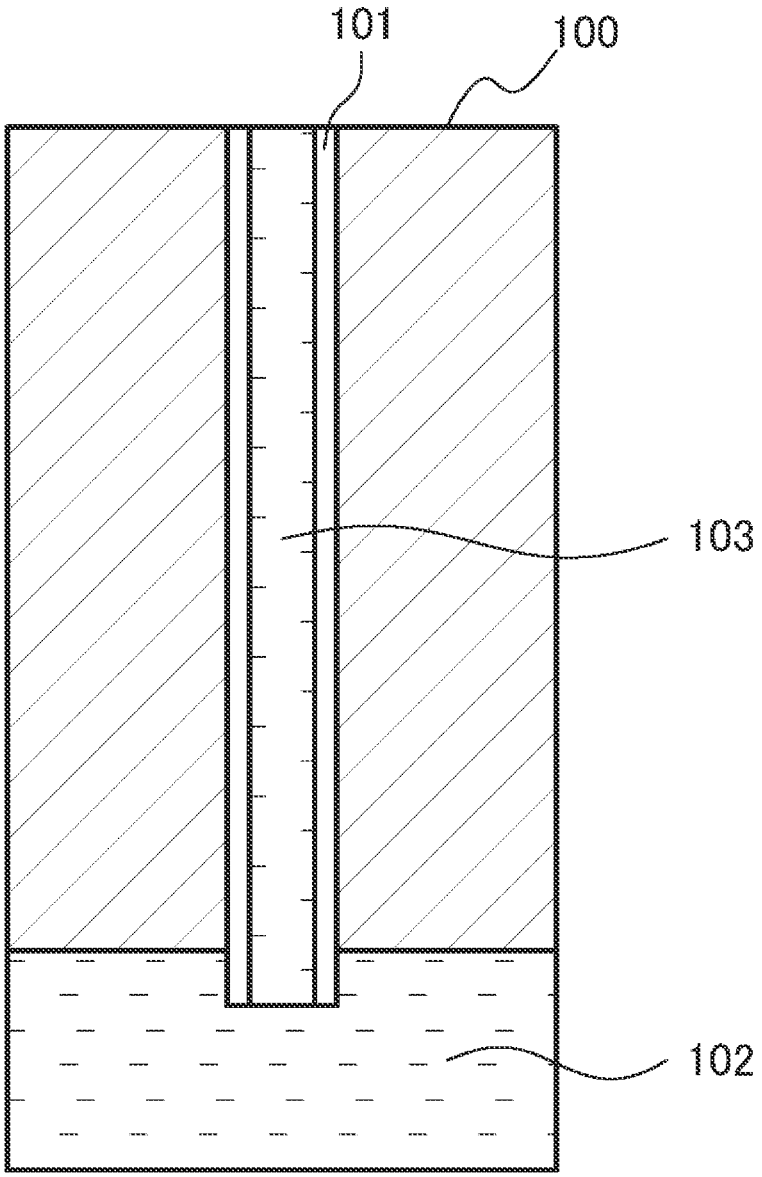
FIG. 1 is a schematic view of an oil well and oil well pipe.

Hereinafter, embodiments of the present invention will be described in detail with reference to the drawings. In the drawings, the same parts or the corresponding parts are represented by the same reference numerals, and a description thereof will not be repeated. Hereinafter, "%" of element content indicates "mass %".

The inventors of the present invention have performed various examinations and investigations, and thus the following findings have been obtained.

Oil well pipe 101 used for a casing or a tubing receives a tensile load FT and a compressive load FI in a pipe axis direction. FIG. 1 is a schematic view of an oil well 102 and the oil well pipes 101. With reference to FIG. 1, the oil well pipes 101 are inserted into a geological layer 100. A lower end of the oil well pipes 101 is arranged in the oil well 102. At this time, the oil well pipes 101 receive the tensile load FT in the pipe axis direction by its own weight. Further, produced fluid 103 passes through the oil well pipes 101. Since the produced fluid 103 is at a high temperature, the oil well pipes 101 expand with heat. In general, the upper end and the lower end of the oil well pipes 101 are fixed. Therefore, when the produced fluid 103 passes through the oil well pipes 101, the oil well pipes 101 receive the compressive load FI in the pipe axis direction. As described above, the oil well pipes 101 receive the tensile load FT and the compressive load FI in the pipe axis direction.

Figure 2:
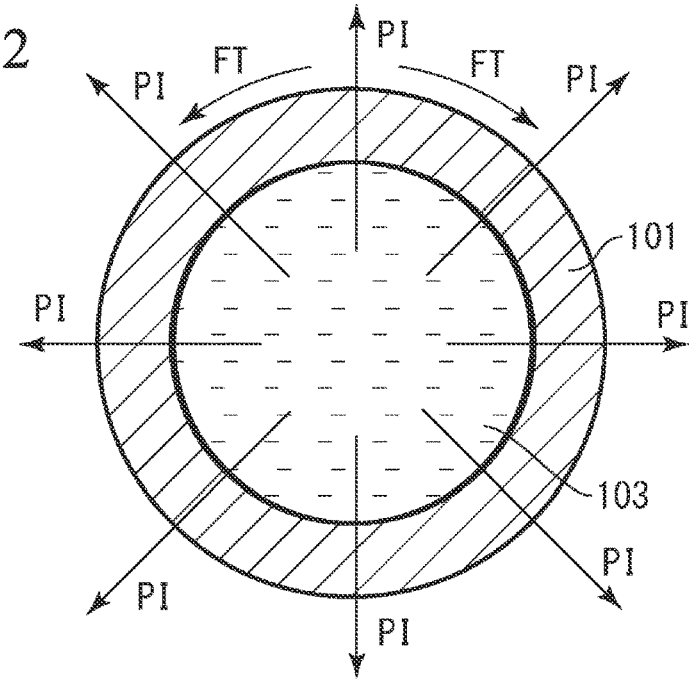
FIG. 2 is a cross-sectional view of the oil well pipe of FIG. 1.

Further, the oil well pipes 101 are also required to have internal pressure resistance and external pressure resistance. FIG. 2 is a cross-sectional view of the oil well pipe 101 of FIG. 1. With reference to FIG. 2, when the produced fluid 103 passes through the oil well pipe 101, internal pressure PI is applied to the oil well pipe 101 by the produced fluid 103. Due to the internal pressure PI, the tensile load FT is applied in a pipe circumferential direction of the oil well pipe 101. Further, due to the tensile load FT in the pipe circumferential direction, the compressive load FI is applied in the pipe axis direction.

Figure 3:
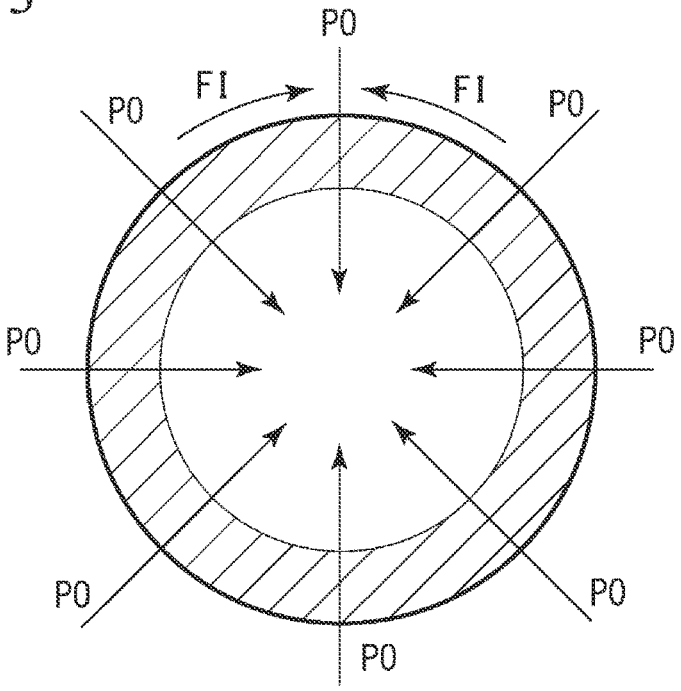
FIG. 3 is another cross-sectional view of the oil well pipe of FIG. 1 which is different from FIG. 2.

Similarly, with reference to FIG. 3, when the oil well pipe 101 is the casing, geopressure PO which is external pressure is applied to an outer surface of the oil well pipe 101. Due to the geopressure PO, the compressive load FI is applied in the pipe circumferential direction of the oil well pipe 101. Then, due to the compressive load FI in the pipe circumferential direction, the tensile load FT is applied in the pipe axis direction.

Such a stress distribution is changed according to an arrangement place of the oil well pipe 101. For example, at the time of drilling, the tubing burrows through the ground while being rotated around the pipe axis. At this time, an utmost tip portion of the tubing repeatedly receives the tensile load FT and the compressive load FI in the pipe axis direction. In addition, the oil well pipe 101 which is arranged near the ground surface receives the tensile load FT in the pipe axis direction and also receive great internal pressure PI.

Therefore, not only a balance between tensile yield strength and compressive yield strength in the pipe axis direction, but also the internal pressure resistance and the external pressure resistance are required for a dual phase stainless steel pipe 1 which is used as the oil well pipe 101.

In order for the dual phase stainless steel pipe 1 to obtain such characteristics, it is necessary to have small anisotropy of the tensile yield strength and the compressive yield strength in the pipe axis direction and the pipe circumferential direction of the dual phase stainless steel pipe 1.

In order to decrease the anisotropy, with respect to the dual phase stainless steel pipe 1 after the cold working, straightening is performed by an inclined roll type straightener 200, and a low temperature heat treatment is performed at 350° C. to 450° C. By performing the straightening and the low temperature heat treatment, a difference in yield strength ratios between the tensile yield strength and the compressive yield strength (the compressive yield strength/the tensile yield strength) in a test piece sampling direction of the manufactured dual phase stainless steel pipe 1 in Expressions (1) to (4) described below decreases. That is, the anisotropy of the yield strength decreases. Specifically, the tensile yield strength $YS_{LT}$ (MPa) in the pipe axis direction and the compressive yield strength $YS_{LC}$ (MPa) in the pipe axis direction of the dual phase stainless steel pipe 1, and the tensile yield strength $YS_{CT}$ (MPa) in the pipe circumferential direction and the compressive yield strength $YS_{CC}$ (MPa) in the pipe circumferential direction of the dual phase stainless steel pipe 1 satisfy Expressions (1) to (4).

$$0.90 \leq YS_{LC}/YS_{LT} \leq 1.11 \quad (1)$$

$$0.90 \leq YS_{CC}/YS_{CT} \leq 1.11 \quad (2)$$

$$0.90 \leq YS_{CC}/YS_{LT} \leq 1.11 \quad (3)$$

$$0.90 \leq YS_{CT}/YS_{LT} \leq 1.11 \quad (4)$$

Reasons that the anisotropy of the yield strength of the dual phase stainless steel pipe 1 decreases by performing the straightening by the inclined roll type straightener 200 and the low temperature heat treatment are assumed to be as follows.

Figure 4:
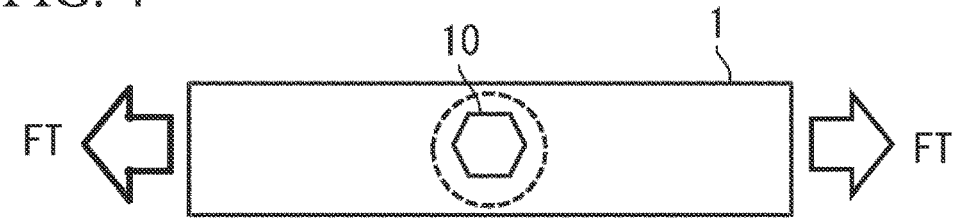
FIG. 4 is a schematic view showing cold working of a dual phase stainless steel pipe.
Figure 5:
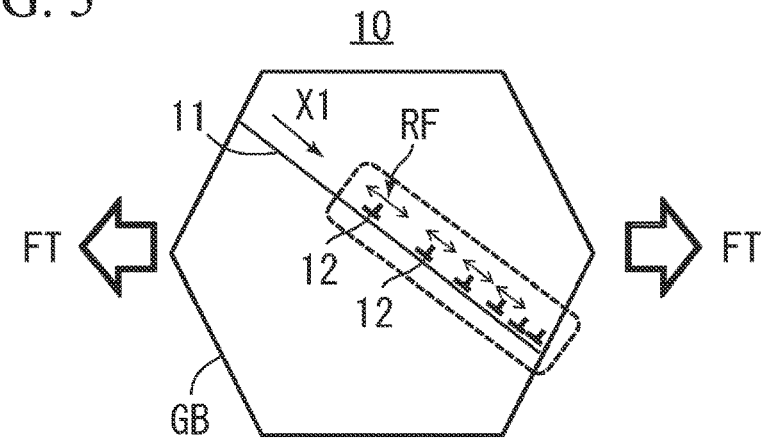
FIG. 5 is a schematic view showing behavior of a dislocation in a crystal grain of the dual phase stainless steel pipe of FIG. 4.

In the cold working, the dual phase stainless steel pipe 1 is stretched in an axial direction while being reduced a diameter of the pipe. Therefore, the cold working introduces tensile strain into the axial direction of the dual phase stainless steel pipe 1, and introduces compression strain into a circumferential direction. As shown in FIG. 4, an arbitrary crystal grain 10 in the dual phase stainless steel pipe 1 will be considered. When the cold working is performed, the tensile load FT is applied in the pipe axis direction of the dual phase stainless steel pipe 1. As a result, as shown in FIG. 5, a plurality of dislocations 12 occurs in a slip system 11. The dislocation 12 is moved in a direction X1 shown in FIG. 5 within the slip system 11, and is accumulated in the vicinity of a grain boundary GB. Repulsive force RF works between the accumulated dislocations 12.

Figure 6:
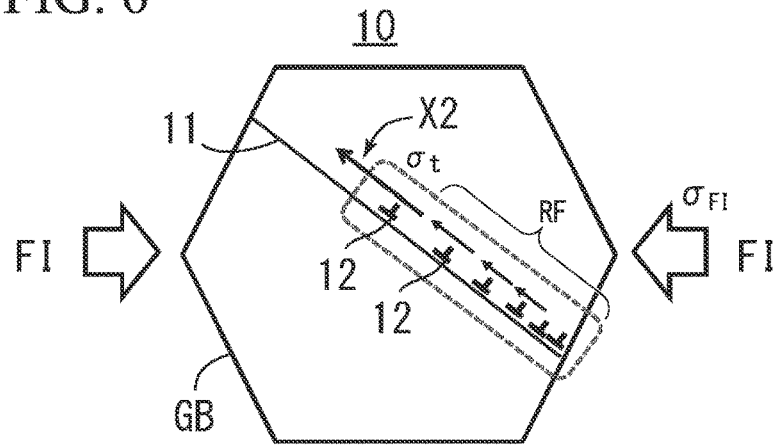
FIG. 6 is a schematic view showing the behavior of the dislocation in the crystal grain when a compressive load is applied to the dual phase stainless steel pipe after the cold working.

Next, the compressive load FI is applied in the pipe axis direction of the dual phase stainless steel pipe 1 as cold-worked (As Cold Worked). In this case, as shown in FIG. 6, the dislocation 12 uses the repulsive force RF in addition to load stress $\sigma_{FI}$ based on the compressive load FI, and is moved in a direction X2 which is opposite to the direction X1 within the slip system 11. In this case, real yielding stress at is defined by Expression (5).

$$\sigma t = \sigma_{FI} + RF \quad (5)$$

Therefore, according to the repulsive force RF which is introduced in advance by the cold working, the dislocation 12 starts to be active by the load stress $\sigma_{FI}$ which is less than the real yielding stress σt. In other word, the Bauschinger effect is generated by the cold working, and thus the compressive yield strength $YS_{LC}$ in the pipe axis direction decreases.

The straightening by the inclined roll type straightener 200 suppresses the Bauschinger effect, and increases the compressive yield strength $YS_{LC}$ in the pipe axis direction of the dual phase stainless steel pipe 1. Reasons thereof are not certain, but are assumed to be as follows.

Figure 7:
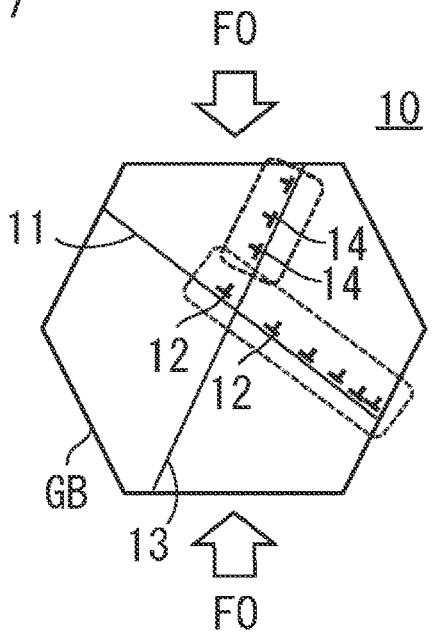
FIG. 7 is a schematic view showing the behavior of the dislocation in the crystal grain when straightening is performed with respect to the dual phase stainless steel pipe after the cold working.

In the straightening by the inclined roll type straightener 200, the dual phase stainless steel pipe 1 is sandwiched between inclined rolls 22, and advances while being rotated around the pipe axis. At this time, the dual phase stainless steel pipe 1 receives external force FO by the inclined roll 22 from a direction (mainly from a radial direction) which is different from the direction of the cold working. For this reason, in the straightening, as shown in FIG. 7, dislocations 14 occur by the external force FO in a slip system 13 different from the slip system 11 which is introduced by the cold working, and the dislocations 14 become active.

The dislocation 14 introduced by the straightening functions as a forest dislocation with respect to the dislocation 12. Further, the dislocation 12 and the dislocation 14 intersect with each other to be crossed. As a result, the dislocation 12 and the dislocation 14 which include a kink portion and a jog portion are generated. The kink portion and the jog portion are formed on a slip plane which is different from other dislocation portions. Therefore, movement of the dislocation 12 and the dislocation 14 including the kink portion and the jog portion is limited. As a result, as shown in FIG. 6, even when the compressive load FI is applied, it is difficult for the dislocation 12 to be moved, and thus the compressive yield strength $YS_{LC}$ is prevented from being decreased.

Further, when the low temperature heat treatment is performed at a heat treatment temperature of 350° C. to 450° C., the anisotropy of the yield strength in the pipe axis direction and in the pipe circumferential direction of the dual phase stainless steel pipe 1 which is subjected to the cold working decreases. The reasons thereof are assumed to be as follows.

The dual phase stainless steel pipe 1 according to this embodiment contains carbon (C) and nitrogen (N). Such elements have a small size compared to an element such as Fe or Ni. Therefore, C and N diffuse through the steel by the low temperature heat treatment, and are adhered to the vicinity of a dislocation core. C or N adhered to the vicinity of the dislocation core interfere with activity of the dislocation 12 and the dislocation 14 by the Cottrell effect.

Figure 8:
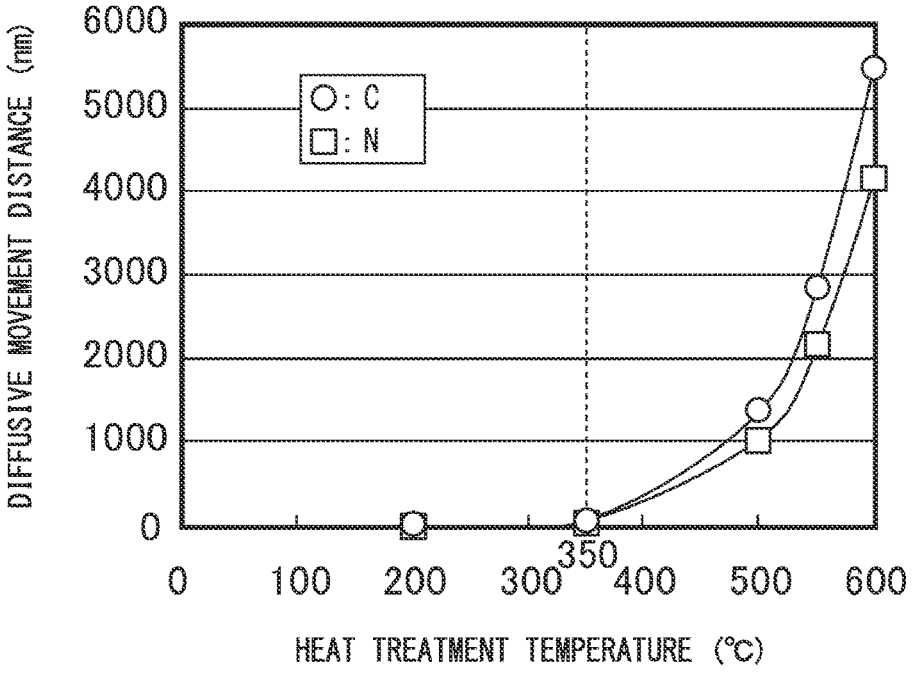
FIG. 8 is a diagram showing a relationship between a heat treatment temperature (° C.) and a diffusive movement distance (nm) of atoms of C (carbon) and N (nitrogen) in austenite when the atoms of C and N are maintained at the heat treatment temperature for 10 minutes.
Figure 9:
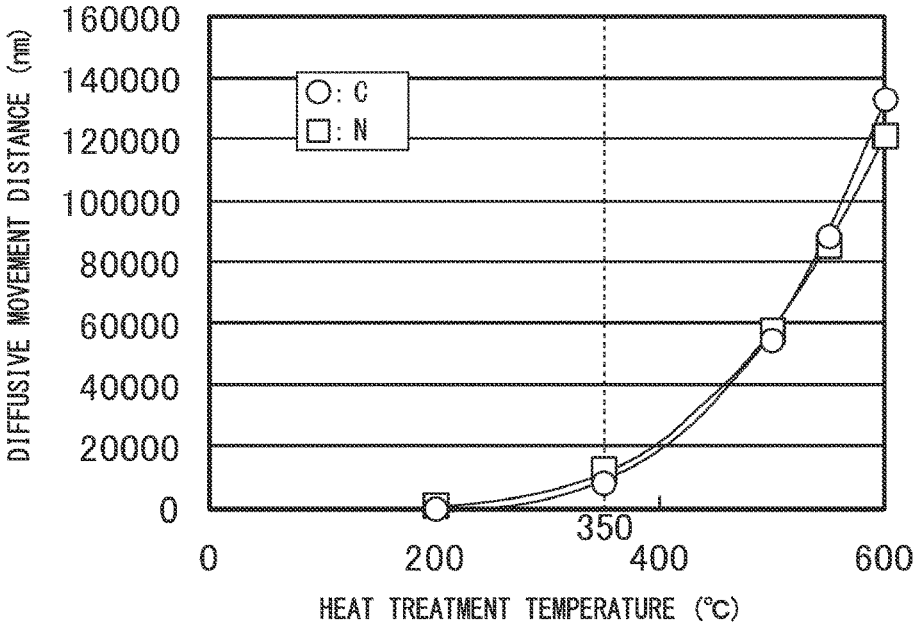
FIG. 9 is a diagram showing a relationship between the heat treatment temperature (° C.) and the diffusive movement distance (nm) of the atoms of C (carbon) and N (nitrogen) in ferrite when the atoms of C and N are maintained at the heat treatment temperature for 10 minutes.

FIG. 8 is a diagram showing a relationship between a heat treatment temperature (° C.) in the low temperature heat treatment, and a diffusive movement distance of C atoms and N atoms in austenite when the C atoms and the N atoms are maintained at the heat treatment temperature for 10 minutes. FIG. 9 is a diagram showing a relationship between the heat treatment temperature (° C.) in the low temperature heat treatment, and a diffusive movement distance of the C atoms and the N atoms in ferrite when the C atoms and the N atoms are maintained at the heat treatment temperature for 10 minutes. In FIG. 8 and FIG. 9, a mark "○" indicates the diffusive movement distance (nm) of C. A mark "□" indicates the diffusive movement distance (nm) of N.

With reference to FIG. 8 and FIG. 9, in both the austenite and the ferrite, before the heat treatment temperature arrives at the vicinity of 350° C., the diffusive movement distance does not increase greatly even when the heat treatment temperature increases. However, when the heat treatment temperature arrives at the vicinity of 350° C., the diffusive movement distance remarkably increases with an increase in the temperature. Specifically, when the C atoms and the N atoms are maintained at the heat treatment temperature of 350° C. or higher for 10 minutes or longer, the diffusive movement distance of the C atoms and the N atoms in the austenite is greater than or equal to 10 nm, and the diffusive movement distance of the C atoms and the N atoms in the ferrite is greater than or equal to 10 μm.

Therefore, when the heat treatment temperature in the low temperature heat treatment is set to 350° C. or higher, and the atoms of C and N are maintained at the heat treatment temperature for 10 minutes or longer, the atoms of C and N sufficiently diffuse, and are adhered to the dislocation core which is introduced into the steel by the cold working. Then, the Cottrell effect is caused by adhesion of the atoms of C and N, and movement of the dislocation 12 and the dislocation 14 is interfered with, and thus the tensile yield strength and the compressive yield strength of the steel tend to be increased, and the tensile yield strength and the compressive yield strength are remarkably increased in a direction affected by the Bauschinger effect.

In general, dislocation density of the steel which is subjected to the cold working is approximately $10^{14\ to\ 23}/m^2$. Therefore, when the diffusive movement distance of the C atoms and the N atoms is greater than or equal to 10 nm which is wider than the average interval between the dislocation 12 and the dislocation 14, the C atoms and the N atoms are able to be adhered to the dislocation core.

On the other hand, when the dual phase stainless steel is maintained at 475° C., 475° C. brittleness is generated. Therefore, the upper limit of the heat treatment temperature in the low temperature heat treatment is 450° C.

As described above, when the low temperature heat treatment is performed at the heat treatment temperature of 350° C. to 450° C., it is assumed that it is difficult for the dislocation 12 and the dislocation 14 which are introduced by a processing treatment (in this embodiment, the cold working) before the heat treatment to be active by the Cottrell effect. Therefore, the low temperature heat treatment suppresses a decrease in the tensile yield strength or in the compressive yield strength by the Bauschinger effect, and reduces the anisotropy of the yield strength in the pipe axis direction and in the pipe circumferential direction of the dual phase stainless steel pipe 1.

As described above, by performing the straightening and the low temperature heat treatment, it is possible to suppress the decrease in the tensile yield strength or in the compressive yield strength caused by the Bauschinger effect which is generated at the time of the cold working. Specifically, as shown in FIG. 7, by the straightening, the dislocation 14 is generated in the slip system 13 which is different from the slip system 11 at the time of the cold working, and hinders the activity of the dislocation 12. Further, by the low temperature heat treatment, C and N are adhered to the vicinity of the dislocation core, and thus interfere with the activity of the dislocation 12 and the dislocation 14. On the basis of the above findings, the dual phase stainless steel pipe 1 according to this embodiment has been completed. Hereinafter, the dual phase stainless steel pipe 1 according to this embodiment will be described in detail.

The dual phase stainless steel pipe 1 according to this embodiment has a dual phase structure of austenite and ferrite.

[Preferable Chemical Composition of Dual Phase Stainless Steel Pipe 1]

Preferably, the dual phase stainless steel pipe 1 has the following chemical compositions. Furthermore, "%" of each element content indicates "mass %".

C: 0.008% to 0.03%

Carbon (C) increases strength by stabilizing the austenite. Further, C forms carbide when the temperature increases in the heat treatment. Accordingly, a fine structure is obtained. However, when a C content exceeds 0.03%, the carbide is excessively precipitated according to a thermal influence at the time of the heat treatment or welding, and thus the corrosion resistance and workability of the steel decrease. Therefore, the C content is set to be less than or equal to 0.03%. When extremely high corrosion resistance and workability of the steel are required, an upper limit thereof may be less than 0.03%, and may be 0.02% or 0.018%. When the C content is less than 0.008%, it is difficult to secure the strength and decarburization costs at the time of manufacturing the steel increase. The lower limit thereof may be 0.010% or 0.014%.

Si: 0% to 1%

Silicon (Si) deoxidizes the steel. Further, Si forms an intermetallic compound when the temperature increases in the heat treatment. Accordingly, the fine structure is obtained. However, when a Si content exceeds 1%, the intermetallic compound is excessively precipitated according to the thermal influence at the time of the heat treatment or the welding, and thus the corrosion resistance and the workability of the steel decrease. Therefore, the Si content is set to be less than or equal to 1%. When extremely high corrosion resistance and workability of the steel are required, the upper limit thereof may be less than 1%, and may be 0.8% or 0.7%. It is not necessary that the lower limit of Si be prescribed, and the lower limit is 0%. Si may be contained in order to form the intermetallic compound or to deoxidize, and as necessary, the lower limit thereof may be 0.05%, 0.1%, or 0.2%.

Mn: 0.1% to 2%

Similar to Si, manganese (Mn) deoxidizes the steel. Further, Mn forms sulfide by being bonded with S in the steel, and fixes S. For this reason, hot workability of the steel increases. When the Mn content is less than 0.1%, it is difficult to obtain the above effects. Therefore, the Mn content is set to be greater than or equal to 0.1%. On the other hand, when the Mn content exceeds 2%, the hot workability and the corrosion resistance of the steel decrease. Therefore, the Mn content is set to be less than or equal to 2%. The lower limit of the Mn content may be greater than 0.1%, and may be 0.2% or 0.3%. In addition, the upper limit of the Mn content may be less than 2%, and may be 1.7% or 1.5%.

Cr: 20% to 35%

Chromium (Cr) increases the strength and maintains the corrosion resistance of the steel. When the Cr content is less than 20%, it is difficult to obtain the above effects. Therefore, the Cr content is set to be greater than or equal to 20%. On the other hand, when the Cr content exceeds 35%, it is easy to generate a σphase, and thus the corrosion resistance and toughness of the steel decrease. Therefore, the Cr content is set to be less than or equal to 35%. The lower limit of the Cr content may be greater than 20%, and may be 22% or 23%. In addition, the upper limit of the Cr content may be less than 35%, and may be 30% or 28%.

Ni: 3% to 10%

Nickel (Ni) stabilizes the austenite, and forms the dual phase structure of the ferrite and the austenite. When the Ni content is less than 3%, a structure mainly includes the ferrite is generated, and thus it is difficult to obtain the dual phase structure. Therefore, the Ni content is set to be greater than or equal to 3%. On the other hand, since Ni is expensive, when the Ni content exceeds 10%, the manufacturing cost increases. Therefore, the Ni content is set to be less than or equal to 10%. The lower limit of the Ni content may be greater than 3%, and may be 5% or 6%. In addition, the upper limit of the Ni content may be less than 10%, and may be 9% or 8%.

Mo: 0% to 4%

Molybdenum (Mo) increases pitting corrosion resistance and crevice corrosion resistance of the steel. Further, Mo increases the strength of the steel by solid solution strengthening. For this reason, Mo is contained as necessary. When any Mo is contained, the above effects are obtained to a certain degree. However, when the Mo content exceeds 4%, the 6 phase is easily precipitated, and thus the toughness of the steel decreases. Therefore, the Mo content is set to be less than or equal to 4%. When the above effects are further required, the upper limit thereof may be less than 4%, and may be 3.8% or 3.5%. It is not necessary that the lower limit of Mo be prescribed, and the lower limit is 0%. In order to remarkably obtain the above effects, Mo may be contained, and as necessary, the lower limit thereof may be 0.5%, may be greater than 0.5%, and may be 2% or 3%.

W: 0% to 6%

Similar to Mo, tungsten (W) increases the pitting corrosion resistance and the crevice corrosion resistance of the steel. Further, W increases the strength of the steel by the solid solution strengthening. For this reason, W is contained as necessary. When any W is contained, the above effects are obtained to a certain degree. However, when the W content exceeds 6%, the a phase is easily precipitated, and thus the toughness of the steel decreases. Therefore, the W content is set to be less than or equal to 6%. When the above effects are further required, the upper limit thereof may be less than 6%, and may be 5% or 4%. It is not necessary that the lower limit of W be prescribed, and the lower limit is 0%. In order to remarkably obtain the above effects, W may be contained, and as necessary, the lower limit thereof may be 0.5%, may be greater than 0.5%, and may be 1% or 2%.

Furthermore, the dual phase stainless steel according to this embodiment may contain neither Mo nor W, and may contain at least one of Mo and W.

Cu: 0% to 3%

Copper (Cu) increases the corrosion resistance and intergranular corrosion resistance of the steel. For this reason, Cu is contained as necessary. When any Cu is contained, the above effects are obtained to a certain degree. However, when the Cu content exceeds 3%, the effect is saturated, and the hot workability and the toughness of the steel further decrease. Therefore, the Cu content is set to be less than or equal to 3%. When the above effects are further required, the upper limit thereof may be less than 3%, and may be 2% or 1%. It is not necessary that the lower limit of Cu be prescribed, and the lower limit is 0%. In order to remarkably obtain the above effects, Cu may be contained, and as necessary, the lower limit thereof may be 0.1%, may be greater than 0.1%, or may be 0.3%.

N: 0.15% to 0.35%

Nitrogen (N) increases stability of the austenite, and increases the strength of the steel. Further, N increases the pitting corrosion resistance and the crevice corrosion resistance of the dual phase stainless steel. When the N content is less than 0.15%, it is difficult to obtain the above effects. Therefore, the N content is set to be greater than or equal to 0.15%. On the other hand, when the N content exceeds 0.35%, the toughness and the hot workability of the steel decrease. Therefore, the N content is set to be less than or equal to 0.35%. The lower limit of the N content may be greater than 0.15%, 0.17%, or may be 0.20%. In addition, the upper limit of the N content may be less than 0.35%, and may be 0.33% or 0.30%.

A remainder of the dual phase stainless steel pipe 1 according to this embodiment is Fe and impurities. As the impurities, ores or scraps which are used as a raw material of the stainless steel, or elements which are mixed from an environment of a manufacturing process or the like is included. Preferably, among the impurities, the P, S, and 0 contents are limited as follows.

P: 0.04% or less

Phosphorus (P) is the impurities which are unavoidably mixed at the time of refining the steel, and is an element which decreases the hot workability, the corrosion resistance, and the toughness of the steel. Therefore, the P content is set to be less than or equal to 0.04%, and preferably, is set to be less than 0.04%, less than or equal to 0.034%, or less than or equal to 0.030%.

S: 0.03% or less

Sulfur (S) is the impurities which are unavoidably mixed at the time of refining the steel, and is an element which decreases the hot workability of the steel. Further, S forms sulfide. The sulfide is a starting point of pitting, and thus decreases the pitting corrosion resistance of the steel. Therefore, the S content is set to be less than or equal to 0.03%, and preferably, is set to be less than 0.003%, less than or equal to 0.001%, or less than or equal to 0.0007%.

O: 0.010% or less

Oxygen (O) is the impurities which are unavoidably mixed at the time of refining the steel, and is an element which decreases the hot workability of the steel. Therefore, the 0 content is set to be less than or equal to 0.010%, and preferably, is set to be less than 0.010%, less than or equal to 0.009%, or less than or equal to 0.008%.

[Manufacturing Method]

An example of the manufacturing method of the dual phase stainless steel pipe 1 according to this embodiment will be described.

First, the dual phase stainless steel is melted in order to manufacture molten metal. The dual phase stainless steel is able to be melted by using an electric furnace, an Ar—$O_2$ mixed gas bottom-blown decarburization furnace (an AOD furnace), a vacuum decarburization furnace (a VOD furnace), or the like.

A cast material is manufactured by using the molten metal. The cast material, for example, is an ingot or a slab, and a bloom. Specifically, the ingot is manufactured by an ingot making method. Alternatively, the slab or the bloom is manufactured by a continuous casting method.

The cast material is subjected to hot working in order to manufacture a round billet. The hot working, for example, is hot rolling or hot forging. The manufactured round billet is subjected to the hot working in order to manufacture a raw pipe 30. Specifically, the raw pipe 30 is manufactured from the round billet by a pipe making method of extrusion which is represented by an Ugine Sejournet process. Alternatively, the raw pipe 30 is manufactured from the round billet by a Mannesmann pipe making method.

The cold working is performed with respect to the manufactured raw pipe 30. Therefore, the strength of the dual phase stainless steel pipe 1 increases, and the tensile yield strength $YS_{LT}$ in the pipe axis direction is 689.1 MPa to 1000.5 MPa.

In the cold working, cold drawing, and cold rolling which is represented by pilger rolling are included. In this embodiment, either the cold drawing or the cold rolling may be adopted. The cold drawing applies great tensile strain in the pipe axis direction to the dual phase stainless steel pipe 1, compared to the cold rolling. The cold rolling applies great strain in the pipe circumferential direction in addition to the pipe axis direction of the raw pipe 30. Therefore, the cold rolling applies great compression strain in the pipe circumferential direction of the raw pipe 30, compared to the cold drawing.

A preferable cross-section reduction ratio at the time of the cold working is greater than or equal to 5.0%. Here, the cross-section reduction ratio is defined by Expression (6).

cross-section reduction ratio=(sectional area of raw pipe 30 before cold working−sectional area of raw pipe 30 after cold working)/sectional area of raw pipe 30 before cold working×100 (6)

When the cold working is performed at the cross-section reduction ratio described above, the tensile yield strength $YS_{LT}$ is 689.1 MPa to 1000.5 MPa. Preferably, the lower limit of the cross-section reduction ratio is 7.0%. When the cross-section reduction ratio is excessively high, roundness of the dual phase stainless steel pipe 1 decreases. Therefore, the upper limit of the preferable cross-section reduction ratio of the cold drawing is 20.0%, and the upper limit of the preferable cross-section reduction ratio of the cold rolling is 40.0%.

Between the hot working and the cold working, other processes may be performed. For example, a solid-solution heat treatment is performed with respect to the raw pipe 30 which is subjected to the hot working, and descaling is performed with respect to the raw pipe 30 after being subjected to the solid-solution heat treatment in order to remove scale. The cold working is performed with respect to the raw pipe 30 after the descaling.

Further, the cold working may be performed a plurality of times. When the cold working is performed a plurality of times, between the cold working and the subsequent cold working, the solid-solution heat treatment may be performed as a softening heat treatment. When the cold working is performed a plurality of times, the following processes are performed with respect to the raw pipe 30 after the final cold working.

With respect to the raw pipe 30 after the cold working, the straightening by the inclined roll type straightener 200, and the low temperature heat treatment are performed. Any one of the straightening and the low temperature heat treatment may be performed first. That is, the straightening may be performed after the cold working, and then the low temperature heat treatment may be performed. The low temperature heat treatment may be performed after the cold working, and then the straightening may be performed. In addition, the straightening may be performed a plurality of times, and the low temperature heat treatment may be performed a plurality of times. For example, the cold working, the first straightening, the low temperature heat treatment, and the second straightening may be performed in sequence. The cold working, the first low temperature heat treatment, the straightening, and the second low temperature heat treatment may be performed in sequence. Hereinafter, the straightening and the low temperature heat treatment will be described in detail.

[Straightening]

Figure 10:
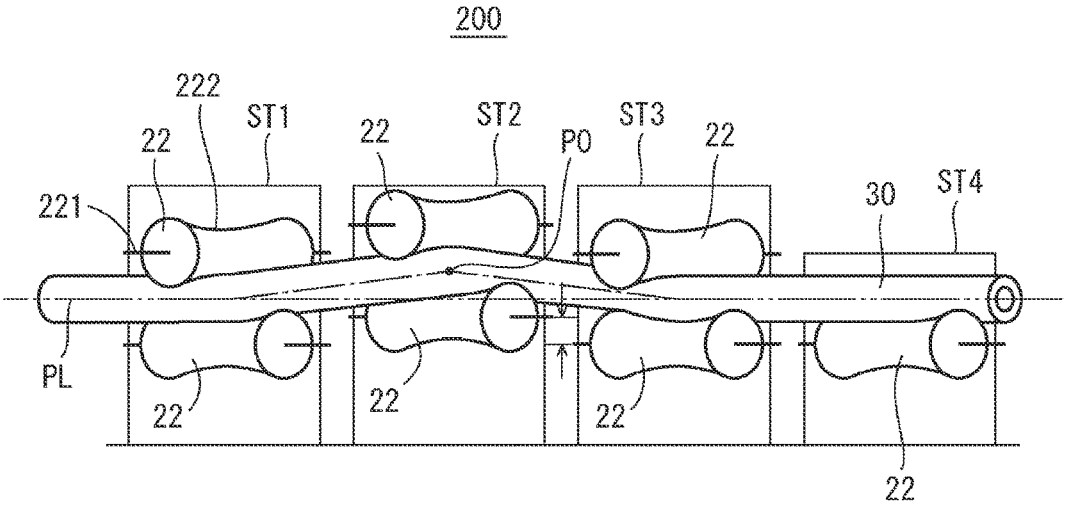
FIG. 10 is a schematic view of a straightener.

FIG. 10 is a schematic view of the straightener 200. With reference to FIG. 10, the straightener 200 used in this embodiment is an inclined roll type. The straightener 200 shown in FIG. 10 includes a plurality of stand ST1 to stand ST4. The pluralities of stand ST1 to stand ST4 are arranged in a line.

The respective stand ST1 to stand ST4 include a pair of or one inclined roll 22. Specifically, the rearmost stand ST4 includes one inclined roll 22, and other stand ST1 to stand ST3 include a pair of inclined rolls 22 which are arranged in the upper and lower sides of the stands.

Each of the inclined rolls 22 includes a roll shaft 221 and a roll surface 222. The roll shaft 221 is inclined with respect to a pass line PL. The roll shafts 221 of the pair of inclined rolls 22 of the respective stand ST1 to stand ST3 intersect with each other. The roll shafts 221 of the inclined rolls 22 which are arranged in the upper and lower sides of the stands are inclined with respect to the pass line PL, and intersect with each other, and thus it is possible to cause the raw pipe 30 to be rotated in the pipe circumferential direction. The roll surface 222 has a concave shape.

A center P0 of a gap between the inclined rolls 22 of the stand ST2 is shifted from the pass line PL. For this reason, the stand ST1 and the stand ST2 bend the raw pipe 30, and the stand ST2 and the stand ST3 bend back the raw pipe 30. Accordingly, the straightener 200 straightens the bent raw pipe 30.

Further, the straightener 200 presses down the raw pipe 30 in the radial direction by the pair of inclined rolls 22 of the respective stands STi (i=1 to 3). Accordingly, the straightener 200 increases the roundness of the raw pipe 30, and reduces the anisotropy of the yield strength of the raw pipe 30.

Figure 11:
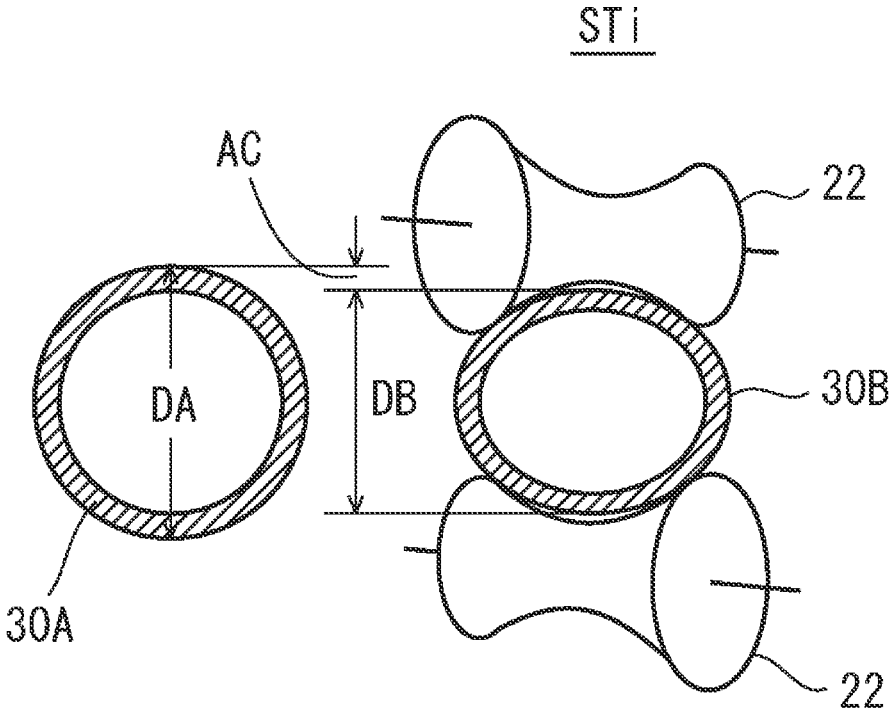
FIG. 11 is a front view of a stand of the straightener shown in FIG. 10.

FIG. 11 is a front view of the inclined roll 22 and the raw pipe 30 in the stand STi including the pair of inclined rolls 22. The raw pipe 30 is pressed down by the pair of inclined rolls 22. When an outer diameter of a raw pipe 30A before being pressed down in the stand STi is defined as DA (mm), and an outer diameter of a raw pipe 30B after being pressed down in the stand STi is defined as DB (mm), a crash amount AC (mm) is defined by Expression (7) described below.

$$AC=DA-DB \quad (7)$$

Further, a crash ratio RC (%) is defined by Expression (8) described below.

$$RC=(DA-DB)/DA\times 100 \quad (8)$$

The respective stands STi press down the raw pipe 30 which is rotated in the circumferential direction according to the crash amount AC set for each of the stands, and apply strain with respect to the raw pipe 30. As illustrated in FIG. 7, the dislocation 14 which occurs in the raw pipe 30 by pressing down raw pipe 30 is active in the slip system 13 unlike the dislocation 12 which occurs at the time of the cold working. Therefore, the dislocation 14 which occurs by the straightening and the dislocation 12 which occurs at the time of the cold working collide with each other to be crossed, and thus it is difficult for the dislocation 12 and the dislocation 14 to be moved. Therefore, the straightening suppresses the decrease in the compression stress strength $YS_{LC}$ in the pipe axis direction by the Bauschinger effect.

As described above, in order to reduce the anisotropy of the yield strength, in particular, the anisotropy of the yield strength in the pipe axis direction, it is effective to press down the raw pipe 30 by the inclined roll 22. The strain is able to be applied in the radial direction of the raw pipe 30 as the crash ratio RC becomes higher. The highest crash ratio RC among the crash ratios RC of the respective stands STi is defined as a maximum crash ratio. By pressing down the raw pipe 30 by the maximum crash ratio, the maximum strain is able to be applied to the raw pipe 30. Therefore, it is assumed that the maximum crash ratio is effective for reducing the anisotropy of the yield strength in the pipe axis direction. Preferably, the maximum crash ratio is 2.0 to 15.0%. More preferably, the lower limit of the maximum crash ratio is 4.0%, and more preferably, the upper limit of the maximum crash ratio is 12.0%.

In FIG. 10, the straightener 200 includes 7 inclined rolls 22, and 4 stand ST1 to stand ST4. However, the number of inclined rolls 22 is not limited to 7, and the number of stands is not limited to 4. The number of inclined rolls 22 may be 10, and may be multiple numbers other than 10. When the number of inclined rolls is an odd number, the rearmost stand includes one inclined roll 22, and the other stands include a pair of inclined rolls 22. When the number of inclined rolls is an even number, the respective stands include a pair of inclined rolls 22.

[Low Temperature Heat Treatment]

In the low temperature heat treatment, the raw pipe 30 is input into the heat treatment furnace. Then, the raw pipe 30 is soaked at the heat treatment temperature of 350° C. to 450° C. By soaking the raw pipe 30 at a temperature range described above, C and N in the raw pipe 30 diffuse to be easily adhered to the vicinity of the dislocation core. As a result, it is difficult for the dislocation 12 and the dislocation 14 to be moved, and the anisotropy of the yield strength in the pipe axis direction and in the pipe circumferential direction is reduced.

When the heat treatment temperature exceeds 450° C., the 475° C. embrittlement of the dual phase stainless steel is generated, and thus the toughness decreases.

A preferable soaking time is more than or equal to 5 minutes. In this case, C and N in the dual phase stainless steel sufficiently diffuse. The upper limit of the preferable soaking time is 60 minutes. Furthermore, since the heat treatment temperature of the low temperature heat treatment decreases, there is no bending in the raw pipe 30 after the heat treatment.

According to the processes described above, the dual phase stainless steel pipe 1 which satisfies Expressions (1) to (4) is manufactured.

As described above, an order of the straightening and the low temperature heat treatment is not particularly limited. However, preferably, the straightening is performed after the cold working, and the low temperature heat treatment is performed after the straightening. In this case, C and N are adhered not only to the dislocation 12 which occurs by the cold working, but also to the dislocation 14 which occurs by the straightening, and thus the Cottrell effect is obtained. For this reason, the anisotropy of the yield strength in the pipe axis direction and in the pipe circumferential direction is more easily decreased.

EXAMPLE

A plurality of dual phase stainless steel pipes 1 were manufactured according to a different manufacturing condition. The anisotropy of the yield strength of the manufactured dual phase stainless steel pipe 1 was investigated.

Steel A and steel B which have chemical compositions shown in Table 1 were melted in order to manufacture an ingot.

TABLE 1

| | Chemical Composition (Unit is Mass %, Remainder is Fe and Impurities) | | | | | | | | |
|---|---|---|---|---|---|---|---|---|---|
| Steel | C | Si | Mn | Cr | Ni | Mo | W | Cu | N |
| A | 0.019 | 0.35 | 0.49 | 25.1 | 6.7 | 3.09 | 2.1 | 0.5 | 0.28 |
| B | 0.014 | 0.34 | 0.50 | 25.1 | 6.7 | 3.18 | 2.2 | 0.5 | 0.29 |

All of the steel A and the steel B were within a preferable chemical composition range of this embodiment. Furthermore, in the steel A and the steel B, the P content was less than or equal to 0.04%, the S content was less than or equal to 0.03%, and the O content was less than or equal to 0.010%.

The manufactured ingot was subjected to hot extrusion, and a plurality of raw pipes 30 for cold working was manufactured. A manufacturing process shown in Table 2 was performed on the raw pipe 30 for cold working, and the dual phase stainless steel pipes 1 of Mark 1 to Mark 16 were manufactured.

TABLE 2

| Mark | Steel | Outer Diameter (mm) | Manufacturing Process | Heat Treatment Temperature (° C.) | Number of Rolls | Maximum Crash Ratio (%) | $YS_{LT}$ (MPa) | $YS_{CT}$ (MPa) | $YS_{LC}$ (MPa) | $YS_{CC}$ (MPa) | F1 ($YS_{LC}/YS_{LT}$) | F2 ($YS_{CC}/YS_{CT}$) | F3 ($YS_{CC}/YS_{LT}$) | F4 ($YS_{CT}/YS_{LT}$) |
|---|---|---|---|---|---|---|---|---|---|---|---|---|---|---|
| 1 | A | 178.0 | AsP/D | — | — | — | 941 | 936 | 749 | 951 | 0.80 | 1.02 | 1.01 | 0.99 |
| 2 | B | 60.0 | CR | — | — | — | 936 | 811 | 809 | 943 | 0.86 | 1.16 | 1.01 | 0.87 |
| 3 | B | 60.0 | CR→STR | — | 7 | 4.0 | 927 | 809 | 841 | 911 | 0.91 | 1.13 | 0.98 | 0.87 |
| 4 | A | 178.0 | P/D→Heat Treatment | 350 | — | — | 919 | 905 | 789 | 934 | 0.86 | 1.03 | 1.02 | 0.98 |
| 5 | A | 178.0 | P/D→Heat Treatment | 450 | — | — | 954 | 920 | 834 | 938 | 0.87 | 1.02 | 0.98 | 0.96 |
| 6 | A | 178.0 | P/D→Heat Treatment→STR | 350 | 7 | 6.0 | 932 | 933 | 840 | 950 | 0.90 | 1.02 | 1.02 | 1.00 |
| 7 | A | 178.0 | P/D→Heat Treatment→STR | 450 | 7 | 6.0 | 965 | 923 | 901 | 963 | 0.93 | 1.04 | 1.00 | 0.96 |
| 8 | A | 178.0 | P/D→Heat Treatment→STR | 450 | 7 | 6.0 | 967 | 945 | 885 | 945 | 0.92 | 1.00 | 0.98 | 0.98 |
| 9 | A | 178.0 | P/D→STR→Heat Treatment | 350 | 7 | 6.0 | 950 | 932 | 885 | 940 | 0.93 | 1.01 | 0.99 | 0.98 |
| 10 | A | 178.0 | P/D→STR→Heat Treatment | 450 | 7 | 6.0 | 959 | 916 | 913 | 944 | 0.95 | 1.03 | 0.98 | 0.96 |

TABLE 2-continued

| Mark | Steel | Outer Diameter (mm) | Manufacturing Process | Heat Treatment Temperature (° C.) | Number of Rolls | Maximum Crash Ratio (%) | $YS_{LT}$ (MPa) | $YS_{CT}$ (MPa) | $YS_{LC}$ (MPa) | $YS_{CC}$ (MPa) | F1 ($YS_{LC}/YS_{LT}$) | F2 ($YS_{CC}/YS_{CT}$) | F3 ($YS_{CC}/YS_{LT}$) | F4 ($YS_{CT}/YS_{LT}$) |
|---|---|---|---|---|---|---|---|---|---|---|---|---|---|---|
| 11 | A | 178.0 | P/D→Heat Treatment→STR | 350 | 7 | 6.0 | 941 | 945 | 881 | 935 | 0.94 | 0.99 | 0.99 | 1.00 |
| 12 | A | 178.0 | P/D→Heat Treatment→STR | 450 | 7 | 6.0 | 983 | 930 | 894 | 960 | 0.91 | 1.03 | 0.98 | 0.95 |
| 13 | A | 178.0 | P/D→Heat Treatment→STR | 450 | 7 | 6.0 | 974 | 927 | 898 | 981 | 0.92 | 1.06 | 1.01 | 0.95 |
| 14 | A | 178.0 | P/D→First STR→Heat Treatment→Second STR | 450 | 7 | First STR: 4.0 Second STR: 6.0 | 979 | 921 | 902 | 967 | 0.92 | 1.05 | 0.99 | 0.94 |
| 15 | B | 60.0 | CR→STR→Heat Treatment | 450 | 7 | 10.0 | 980 | 940 | 919 | 990 | 0.94 | 1.05 | 1.01 | 0.96 |
| 16 | B | 60.0 | CR→STR→Heat Treatment | 450 | 7 | 10.0 | 969 | 955 | 921 | 981 | 0.95 | 1.03 | 1.01 | 0.99 |

With reference to Table 2, in a section for Steel, types of used billet (the steel A and the steel B) are described. In a section for Outer Diameter, outer diameters (60.0 mm and 178.0 mm) of the manufactured dual phase stainless steel pipe 1 are described.

In a section for Manufacturing Process, manufacturing processes which were performed with respect to the raw pipe 30 for cold working are described. With reference to the section for Manufacturing Process, AsP/D indicates as cold-drawn. P/D indicates the cold drawing. CR indicates the cold rolling. STR indicates the straightening. Heat Treatment indicates the low temperature heat treatment.

In this example, the cross-section reduction ratio of the cold drawing was 8%, and the cross-section reduction ratio of the cold rolling was 16%. Here, the cross-section reduction ratio (%) was obtained by Expression (6) described above.

In a section for Heat Treatment Temperature, the heat treatment temperatures (° C.) of the low temperature heat treatment which was performed during the manufacturing process are described. In a section for Number of Rolls, the numbers of inclined rolls of the straightener 200 which is used for the straightening are described. In a section for Maximum Crash Ratio, the maximum crash ratios (%) at the time of straightening are described.

Specifically, the following manufacturing processes were performed with respect to the raw pipes 30 for cold working (hereinafter, simply referred to as the "raw pipe 30") of Mark 1 to Mark 16. Only the cold drawing was performed with respect to the raw pipe 30 of Mark 1, and the dual phase stainless steel pipe 1 was manufactured. That is, the dual phase stainless steel pipe 1 of Mark 1 was a material as cold-drawn (As Cold Drawn). In Mark 2, only the cold rolling was performed with respect to the raw pipe 30, and the dual phase stainless steel pipe 1 was manufactured.

In Mark 3, with respect to the raw pipe 30, the cold rolling was performed, and then the straightening was performed at the maximum crash ratio (%) shown in Table 2. In Mark 4 and Mark 5, with respect to the raw pipe 30, the cold drawing was performed, and then the low temperature heat treatment was performed at the heat treatment temperature shown in Table 2.

In Mark 6 to Mark 8 and Mark 11 to Mark 3, the cold drawing was performed with respect to the raw pipe 30. The low temperature heat treatment was performed with respect to the raw pipe 30 which was subjected to the cold drawing. The straightening was performed with respect to the raw pipe 30 after the heat treatment. In Mark 9 and Mark 10, with respect to the raw pipe 30, the cold drawing was performed, and then the straightening was performed. After the straightening, the low temperature heat treatment was performed with respect to the raw pipe 30.

In Mark 14, the straightening was performed with respect to the raw pipe 30 two times. Specifically, after the cold drawing was performed with respect to the raw pipe 30, the first straightening (the first STR) was performed. The maximum crash ratio at the time of the first straightening was 4.0%. After the first straightening, the low temperature heat treatment was performed. The second straightening (the second STR) was performed with respect to the raw pipe 30 after being subjected to the heat treatment. The maximum crash ratio at the time of the second straightening was 6.0%.

In Mark 15 and Mark 16, with respect to the raw pipe 30, the cold rolling was performed, and then the straightening was performed. After the straightening, the low temperature heat treatment was performed with respect to the raw pipe 30.

A compression test piece and a tension test piece were sampled from the manufactured dual phase stainless steel pipes 1 of each of the Marks. Specifically, the tension test piece and the compression test piece which extend in the pipe axis direction of each of the Marks were sampled, and the tension test piece and the compression test piece which extend in the pipe circumferential direction of each of the Marks were sampled.

A dimension of the test piece was based on American Society for Testing and Materials (ASTM)-E8 and ASTM-E9 . An outer diameter of the compression test piece, and a standard test piece for the compression test piece were all 6.35 mm, and distances between reference points were all 12.7 mm. In each of the Marks, when the standard test piece was not able to be sampled, a proportionate test piece was sampled.

By using the sampled compression test piece and tension test piece, a compression test and a tension test were performed at normal temperature (25° C.) in an atmosphere, and the compressive yield strength and the tensile yield strength were obtained. Specifically, by using the tension test piece extending in the pipe axis direction, the tensile yield strength $YS_{LT}$ (MPa) in the pipe axis direction was obtained. By using the tension test piece extending in the pipe circumferential direction, the tensile yield strength $YS_{CT}$ (MPa) in the pipe circumferential direction was obtained. By using the compression test piece extending in the pipe axis direction, the compressive yield strength $YS_{LC}$ (MPa) in the pipe axis direction was obtained. By using the compression test piece extending in the pipe circumferential direction, the compressive yield strength $YS_{CC}$ (MPa) in the pipe circumferential direction was obtained. Each of the yield strength items was defined by the proof stress of 0.2% in the tension test and in the compression test. Each of the obtained yield strength items ($YS_{LT}$, $YS_{CT}$, $YS_{LC}$, and $YS_{CC}$) was shown in Table 2.

By using each of the obtained yield strength items, F1 to F4 shown in Expressions (1) to (4) described below were obtained for each of the Marks.

$$F1=YS_{LC}/YS_{LT} \quad (1)$$

$$F2=YS_{CC}/YS_{CT} \quad (2)$$

$$F3=YS_{CC}/YS_{LT} \quad (3)$$

$$F4=YS_{CT}/YS_{LT} \quad (4)$$

Obtained F1 to F4 are shown in Table 2.

[Investigation Result]

With reference to Table 2, in the dual phase stainless steel pipes 1 of Mark 6 to Mark 16, F1 to F4 satisfied all Expressions (1) to (4). In particular, in Mark 9, Mark 10, Mark 15, and Mark 16, the low temperature heat treatment was performed after the straightening. For this reason, the anisotropy (a value of F1) of the yield strength in the pipe axis direction was extremely small compared to values of F2 to a value of F4.

On the other hand, in the dual phase stainless steel pipes 1 of Mark 1 to Mark 5, at least one of F1 to F4 did not satisfy Expressions (1) to (4). Specifically, the value of F1 in Mark 1 was less than 0.90. The raw pipe 30 of Mark 1 was stretched in the axial direction by the cold drawing. Therefore, it is assumed that the compressive yield strength $YS_{LC}$ in the pipe axis direction was smaller than the tensile yield strength $YS_{LT}$ excessively in the pipe axis direction according to the Bauschinger effect.

In Mark 2, the value of F1 and the value of F4 were less than 0.90, and the value of F2 exceeded 1.11. With respect to the raw pipe 30 of Mark 2, only the cold rolling was performed. The raw pipe 30 during the cold rolling deformed by the tensile stress in the axial direction, and deformed by the compressive stress in the circumferential direction. In particular, compressive distortion in the circumferential direction of the raw pipe 30 in the cold rolling was greater than that in the cold drawing. In Mark 2, according to the Bauschinger effect, the compressive yield strength $YS_{LC}$ in the pipe axis direction was smaller than the tensile yield strength $YS_{LT}$ excessively, and the tensile yield strength $YS_{CT}$ in the pipe circumferential direction was smaller than the compressive yield strength $YS_{CC}$ excessively. For this reason, it is assumed that the value of F1, the value of F2, and the value of F4 did not satisfy Expressions (1), (2), and (4).

In Mark 3, the value of F2 and the value of F4 did not satisfy Expressions (2) and (4). By performing the straightening, the compressive yield strength $YS_{LC}$ in the pipe axis direction was improved. However, it is assumed that the low temperature heat treatment was not performed, and thus the anisotropy of the tensile yield strength and the compressive yield strength in the pipe circumferential direction was not improved, and as a result, the value of F2 and the value of F4 did not satisfy Expressions (2) and (4).

In Mark 4 and Mark 5, the value of F1 did not satisfy Expression (1). It is assumed that the compressive yield strength in the pipe axis direction was improved by the low temperature heat treatment, but the straightening was not performed, and thus the value of F1 did not satisfy Expression (1).

As described above, the embodiments of the present invention have been described, but the embodiments described above are merely examples of implementing the present invention. Accordingly, the present invention is not limited to the embodiments described above, and may be implemented by appropriately changing the embodiments described above without departing from the gist thereof.

INDUSTRIAL APPLICABILITY

In a dual phase stainless steel pipe according to the present invention, anisotropy of yield strength is small, and thus it is able to be durably used even when a different stress distribution is applied according to a use environment. Therefore, it is able to be widely used as oil well pipe. In particular, it is able to be used for tubing or casing.

BRIEF DESCRIPTION OF THE REFERENCE SYMBOLS

1: DUAL PHASE STAINLESS STEEL PIPE
10: CRYSTAL GRAIN
11, 13: SLIP SYSTEM
12, 14: DISLOCATION
22: INCLINED ROLL
30, 30A, 30B: RAW PIPE
100: GEOLOGICAL LAYER
101: OIL WELL PIPE
102: OIL WELL
103: PRODUCED FLUID
200: STRAIGHTENER
221: ROLL SHAFT
222: ROLL SURFACE
AC: CRASH AMOUNT
DA, DB: OUTER DIAMETER
FI: COMPRESSIVE LOAD
FO: EXTERNAL FORCE
FT: TENSILE LOAD
GB: GRAIN BOUNDARY
P0: CENTER OF GAP BETWEEN INCLINED ROLLS 22 OF STAND ST2
PI: INTERNAL PRESSURE
PL: PASS LINE
PO: GEOPRESSURE
RF: REPULSIVE FORCE
ST1, ST2, ST3, ST4, STi: STAND
X1, X2: DIRECTION
$\sigma_{FI}$: LOAD STRESS
σT: REAL YIELDING STRESS

The invention claimed is:

1. A dual phase stainless steel pipe, comprising:

a tensile yield strength $YS_{LT}$ of 689.1 MPa to 1000.5 MPa in a pipe axis direction of the dual phase stainless steel pipe, wherein the tensile yield strength $YS_{LT}$, a compressive yield strength $YS_{LC}$ in the pipe axis direction, a tensile yield strength $YS_{CT}$ in a pipe circumferential direction of the dual phase stainless steel pipe, and a compressive yield strength $YS_{CC}$ in the pipe circumferential direction satisfy all Expressions (1) to (4), the dual phase stainless steel pipe has a dual phase structure of austenite and ferrite, the dual phase stainless steel pipe is manufactured by performing a straightening and a low temperature heat treatment at a heat treatment temperature of 350° C. to 450° C. after being subjected to cold working, and a maximum crash ratio during the straightening is 2.0 to 15.0%, $$0.90 \leq YS_{LC}/YS_{LT} \leq 1.11 \quad (1)$$

$$0.90 \leq YS_{CC}/YS_{CT} \leq 1.11 \quad (2)$$

$$0.90 \leq YS_{CC}/YS_{LT} \leq 1.11 \quad (3)$$

$$0.90 \leq YS_{CT}/YS_{LT} \leq 1.11 \quad (4).$$

2. The dual phase stainless steel pipe according to claim 1, wherein the dual phase stainless steel pipe contains, in mass %, C: 0.008% to 0.03%;
Si: 0% to 1%;
Mn: 0.1% to 2%;
Cr: 20% to 35%;
Ni: 3% to 10%;
Mo: 0% to 4%;
W: 0% to 6%;
Cu: 0% to 3%; and
N: 0.15% to 0.35%, and
a remainder composed of Fe and impurities.

3. The dual phase stainless steel pipe according to claim 1, wherein the dual phase stainless steel pipe is manufactured by performing the low temperature heat treatment after the straightening.

4. The dual phase stainless steel pipe according to claim 2, wherein the dual phase stainless steel pipe is manufactured by performing a straightening and a low temperature heat treatment at a heat treatment temperature of 350° C. to 450° C. after being subjected to cold working.

5. The dual phase stainless steel pipe according to claim 4, wherein the dual phase stainless steel pipe is manufactured by performing the low temperature heat treatment after the straightening.

6. The dual phase stainless steel pipe according to claim 1, wherein the tensile yield strength $YS_{CT}$ in a pipe circumferential direction of the dual phase stainless steel pipe, and the compressive yield strength $YS_{CC}$ in the pipe circumferential direction satisfy $0.90 \leq YS_{CC}/YS_{CT} \leq 1.04$.

* * * * *